US007669643B2

(12) United States Patent
Ekelund et al.

(10) Patent No.: US 7,669,643 B2
(45) Date of Patent: Mar. 2, 2010

(54) PLATE HEAT EXCHANGER DEVICE AND A HEAT EXCHANGER PLATE

(75) Inventors: Rolf Ekelund, Klippan (SE); Rolf Christensen, Veberöd (SE); Ingvar Lindholm, Örsjö (SE)

(73) Assignee: Alfa Laval Corporate AB, Lund (SE)

( * ) Notice: Subject to any disclaimer, the term of this patent is extended or adjusted under 35 U.S.C. 154(b) by 1248 days.

(21) Appl. No.: 10/514,669

(22) PCT Filed: May 19, 2003

(86) PCT No.: PCT/SE03/00803

§ 371 (c)(1),
(2), (4) Date: Nov. 16, 2004

(87) PCT Pub. No.: WO03/100338

PCT Pub. Date: Dec. 4, 2003

(65) Prior Publication Data

US 2005/0211421 A1 Sep. 29, 2005

(30) Foreign Application Priority Data

May 29, 2002 (SE) ..... 0201597

(51) Int. Cl.
*F28B 3/00* (2006.01)
*F28B 9/10* (2006.01)

(52) U.S. Cl. ..... 165/114; 165/70; 165/111; 165/167; 165/174

(58) Field of Classification Search ..... 165/70, 165/111, 114, 166, 167, 174, 182; *F28B 1/00; F28F 3/08*
See application file for complete search history.

(56) References Cited

U.S. PATENT DOCUMENTS

| | | | | |
|---|---|---|---|---|
| 3,559,722 | A | 2/1971 | Schauls et al. | |
| 3,631,923 | A * | 1/1972 | Izeki | 165/167 |
| 4,216,002 | A * | 8/1980 | Rosenblad | 203/87 |
| 4,370,868 | A * | 2/1983 | Kim et al. | 62/504 |
| 5,443,115 | A * | 8/1995 | Pedersen et al. | 165/70 |
| 5,913,361 | A * | 6/1999 | Engstrom et al. | 165/70 |

(Continued)

FOREIGN PATENT DOCUMENTS

| | | |
|---|---|---|
| JP | 59191894 | 10/1984 |

(Continued)

*Primary Examiner*—Ljiljana (Lil) V Ciric
(74) *Attorney, Agent, or Firm*—Fish & Richardson P.C.

(57) ABSTRACT

A device, including a heat exchanger plate and a plate package (2) of heat exchanger plates (1) which are provided beside each other to form a plate interspace between adjacent plates. The plate interspaces form, in an alternating order, first passages (3) for a first medium and second passages (4) for a second medium which cools the first medium. Each heat exchanger plate has at least two portholes forming a first inlet port channel and a first outlet port channel (7), which extend through the plate package to a first inlet and a first outlet, respectively, for the first medium to and from the first passages (3). The first outlet forms a gas outlet (31) for discharging a gaseous portion of the first medium and a liquid outlet (32) for discharge of liquid of the first medium. The liquid outlet (32) is separated from the gas outlet (31) to permit separate discharge of the liquid and gaseous portions.

22 Claims, 7 Drawing Sheets

U.S. PATENT DOCUMENTS

| | | | | |
|---|---|---|---|---|
| 5,983,992 | A | 11/1999 | Child et al. | |
| 6,032,470 | A | 3/2000 | Haselden | |
| 6,401,804 | B1 * | 6/2002 | Shimoya et al. | 165/70 |
| 6,536,511 | B1 * | 3/2003 | Nilsson et al. | 165/113 |
| 7,124,580 | B2 * | 10/2006 | Paredes | 60/508 |
| 2003/0102107 | A1 * | 6/2003 | Nilsson et al. | 165/70 |

FOREIGN PATENT DOCUMENTS

| | | | |
|---|---|---|---|
| JP | 59191895 | | 10/1984 |
| JP | 3181760 | | 8/1991 |
| JP | 4139364 | | 5/1992 |
| JP | 4257670 | | 9/1992 |
| JP | 4320771 | | 11/1992 |
| JP | 8271091 | | 10/1996 |
| JP | 10339589 | A * | 12/1998 |
| SE | 514 092 | | 1/2001 |
| WO | 01/88445 | | 11/2001 |

* cited by examiner

PLATE HEAT EXCHANGER DEVICE AND A HEAT EXCHANGER PLATE

THE BACKGROUND OF THE INVENTION AND PRIOR ART

The present invention refers to a plate heat exchanger device, including a plate package formed by a number of heat exchanger plates, which are arranged beside each other in such a manner that a plate interspace is formed between adjacent plates, which plate interspaces form first passages for a first medium and second passages for a second medium, that is arranged to cool the first medium, wherein the first passages and the second passages are arranged beside each other in the plate package in an alternating order, wherein the first passages are separated from the second passages, and wherein substantially each heat exchanger plate has at least two portholes forming a first inlet port channel and a second outlet port channel, which extend through the plate package to a first inlet and a first outlet, respectively, for the first medium to and from the first passages.

The invention also refers to a heat exchanger plate for a plate heat exchanger device, which heat exchanger plate includes a main extension plane, at least a first porthole, which has an opening area and is arranged to form a part of a first inlet port channel in the plate heat exchanger device for a first inlet for a first medium, and a second porthole, which has an opening area and is arranged to form a part of a first outlet port channel in the plate heat exchanger device for a first outlet for the first medium.

In such a plate heat exchanger device, where the first medium is cooled by the second medium, liquid will condense from the first medium which thus will include a gaseous phase and a liquid phase. It is known to separate these phases from each other in a liquid separator provided after the plate heat exchanger proper. Such devices, including a heat exchanger and a separate liquid separator, may be used in various applications, for instance for the dehumidification of pressurised air from compressors before the pressurised air is supplied to pneumatic tools or machines. Such devices with a separate heat exchanger and a separate liquid separator have the disadvantage that a significant number of components and connecting conduits are required. However, it has appeared to be difficult to provide one single unit for the heat exchanger part as well as the separation part to reasonable costs due to the high pressure such a unit has to withstand. In normal cases, the parts should withstand a pressure of 8 bars, but there are also pneumatic systems operating at 13 bars and even higher pressures.

SE-514 092 discloses a device including a number of parallel plates, which are connected to each other and arranged beside each other in such a way that they by means of portholes of the plates form a first passage, which is arranged to transport a gas, and at least a second passage, which is separated from but in heat transferring contact with the first channel and which is arranged to transport a cooling medium for cooling of the gas. A part of the first passage forms a separating part for separating liquid from the gas. The separating part is formed by a plurality of plate interspaces between some of said plates arranged to be passed on both sides by the flowing gaseous medium. In this case, the heat exchanger and the liquid separator are thus built together to one unit, but they still are parts separated from each other in the device.

SUMMARY OF THE INVENTION

The object of the present invention is to provide an efficient separation of liquid from a substantially gaseous medium and to prevent remixing of the liquid with the gaseous medium. In particular, it is aimed at a plate heat exchanger device permitting such a separation in such a manner that liquid and gas may be conveyed out of the plate heat exchanger device in two separate outlet flows.

This object is achieved by the plate heat exchanger device initially defined, which is characterised in that the first outlet forms a gas outlet, which is arranged to permit discharge of substantially gas of the first medium, and a liquid outlet, which is arranged to permit discharge of substantially liquid of the first medium, wherein the liquid outlet is separated from the gas outlet for permitting separate discharge of said liquid and gas.

The inventors have found that in a plate heat exchanger for cooling of a substantially gaseous medium containing liquid or moisture, a precipitation of liquid on the heat exchanger plates takes place. By designing the outlet in accordance with the invention, it is possible to discharge the gas and the liquid in two separate media flows. It is thus possible to obtain such an efficient separation of liquid and gas already in the plate heat exchanger that the liquid separator used in accordance to the prior art is not any longer necessary. The combined cooling and a separating function may thus be obtained by merely one plate heat exchanger device of the type defined in claim 1. The device is thus very compact.

The device according to the invention may be used within many different technical fields, for instance for drying pressurised air, within petroleum industry for separating heavy hydrocarbons from more highly volatile hydrocarbons such as natural gas, in sugar industry etc.

According to an embodiment of the invention, substantially each of the first passages includes at least one liquid channel, which extends along a substantial part of the first passage in a direction towards the liquid outlet, wherein said liquid channel is arranged to convey liquid of the first medium to the liquid outlet. By means of such a liquid channel, it is thus possible to collect the liquid that precipitates in the plate interspaces forming the first passages already before the first medium reaches the first outlet. The collected liquid may thus via the liquid channel be conveyed through the first passage without being in direct contact with the gas of the first medium. In such a way the risk that liquid is remixed with the gas before the liquid is discharged from the plate package is reduced.

According to a further embodiment of the invention, substantially each heat exchanger plate includes a heat transfer area with a corrugation including ridges and valleys, wherein the corrugation will catch liquid from the second medium. By these ridges and valleys, a plurality of redirections of the first medium are thus achieved when it is transported from the first inlet to the first outlet, and at the same time cooled by said heat transfer area. These redirections of the flow contribute to the precipitation of liquid on the ridges and valleys. Advantageously, the corrugation of said ridges and valleys of one of the two heat exchanger plates limiting every first passage may extend in a direction towards said liquid channel and thus convey the caught liquid to the liquid channel.

According to a further embodiment of the invention, the corrugation of at least one of the two heat exchanger plates limiting every first passage includes a transversal ridge projecting into the first passage in the proximity of the first outlet in such a way that liquid of the first medium is prevented from reaching the gas outlet. Liquid or moisture in the first medium will precipitate on this transversal ridge since the first medium is redirected when it passes the ridge.

According to a further embodiment of the invention, said liquid channel is formed by a shaping of at least one of the two heat exchanger plates that delimits each first passage. Such a shaping may in an easy manner be obtained when the heat exchanger plate is pressed. The liquid channel may extend through or beside said corrugation as a longitudinal depression seen from the plate interspace in question. Advantageously, said liquid channel may extend immediately inside at least an outer edge of the first passage.

According to a further embodiment of the invention, the device is arranged to permit gas of the first medium to flow in a main first flow direction from the first inlet port channel to the first outlet port channel. Advantageously, said transversal ridge may extend transversally to the first flow direction.

According to a further embodiment of the invention, the liquid outlet is connectable to a liquid discharge conduit, which extends from the plate package. Moreover, the gas outlet may be connectable to a gas discharge conduit, which extends from the plat package.

According to a further embodiment of the invention, the plate package has during normal use an upper end and a lower end, which is located beneath the upper end with regard to the direction of gravity, wherein the first inlet port channel is located in the proximity of the upper end and the first outlet port channel is located in the proximity of the lower end. Liquid which precipitates from the first medium in the first passages will thus be transported by means of the gravity to the liquid discharge member via the liquid channel. The gas outlet may have an outlet opening with a centre point which during normal use is located at a higher level than a centre point of an outlet opening of the liquid outlet with regard to the direction of gravity. The outlet opening of the gas outlet is advantageously larger than the outlet opening of the liquid outlet.

According to a further embodiment of the invention, at least one of the two heat exchanger plates, which delimits each first passage, is formed in such a way that the transition between the first passage and the first outlet port channel forms a throttling for the first medium flowing out into the port channel. In such a way a velocity increase is achieved in the transition between the first passage and the port channel. Possibly remaining liquid droplets will thus be accelerated and less inclined to change direction, i.e. to be conveyed out together with the gas through the gas outlet. Furthermore, such a throttling creates a recirculation zone in the proximity of the throttling within the port channel proper. In such a recirculation zone there is a relatively stillstanding gas, which attracts liquid droplets that may fall down towards the liquid outlet. Said throttling may for instance be formed by an edge area extending around at least the gas outlet and inwardly towards a centre plane of the plate interspace. Such an edge area may also in an easy manner be obtained when the heat exchanger plate is pressed.

According to a further embodiment of the invention, each heat exchanger plate has two further portholes forming a second inlet port channel and a second outlet port channel, which extend through the plate package and which form a second inlet and a second outlet, respectively, for the second medium to and from the second passages.

According to a further embodiment of the invention, the liquid outlet is positioned in the proximity of the gas outlet. The liquid outlet may thus be provided in a part of the first outlet whereas the gas outlet is provided in another part of the first outlet. The first outlet may form or constitute a prolongation of a porthole or an opening in substantially each heat exchanger plate, wherein this opening is divided into an upper part for the discharge of gas and a lower part for the discharge of liquid. The liquid outlet may include or be connected to a liquid conduit extending from the lower part, and the gas outlet may include or be connected to a gas conduit extending from the upper part. It is to be noted that the gas and the liquid may be stratified in the port channel for the first outlet, which means that the invention may be realised without any physical dividing member between the liquid outlet and the gas outlet. It is sufficient that the gas stream and the liquid stream, when they have left the device proper, are caught by separate members such as a separate gas conduit and a separate liquid conduit, respectively. The first outlet may also include or be formed by two separate portholes or openings through substantially each heat exchanger plate, wherein such an opening forms the liquid outlet, which includes or is connected to a liquid conduit, and the second opening forms the gas outlet, which includes or is connected to a gas conduit.

According to a further embodiment of the invention, the first outlet includes at least a further heat exchanger plate, which is provided at the plate package for forming a further plate interspace arranged to convey said gas from the first outlet port channel to the gas outlet. By such an additional plate, said gas may in an easy manner be conveyed away from the liquid outlet, and the separation of liquid and gas may be further improved. Advantageously, the said further heat exchanger plate is provided at the plate package in such a way that it forms a part of the plate package.

According to a further embodiment of the invention, the first outlet includes a plurality of further heat exchanger plates, which are provided beside each other and at the plate package for forming further plate interspaces, wherein at least every second one of said further plate interspaces are arranged to convey said gas from the first outlet port channel to the gas outlet. In such a way the separation may be further improved. Advantageously, said further heat exchanger plates are provided at the plate package in such a way that they form a part of the plate package. Furthermore, every second one of said further plate interspaces may be arranged form a part of the first inlet and to convey the first medium to the first inlet port channel in heat exchanging contact with said gas.

The object is also achieved by the heat exchanger plate initially defined, which is characterised in that the opening area of the second porthole is substantially larger than the opening area of the first porthole, and that the second porthole is arranged to permit discharge of the first medium to a gas outlet, which is arranged to permit discharge of substantially gas of the first medium, and to a liquid outlet, which is arranged to permit discharge of substantially liquid of the first medium, wherein the liquid outlet is separated from the gas outlet for permitting separate discharge of said liquid and gas. In such a way a separation of a gas flow and a liquid flow from a heat exchanger device formed by such plates is made possible.

BRIEF DESCRIPTION OF THE DRAWINGS

The present invention is now to be explained more closely by means of a description of various embodiments disclosed by way of example and with reference to the drawings attached hereto.

DETAILED DESCRIPTION OF VARIOUS EMBODIMENTS OF THE INVENTION

Figure 1:
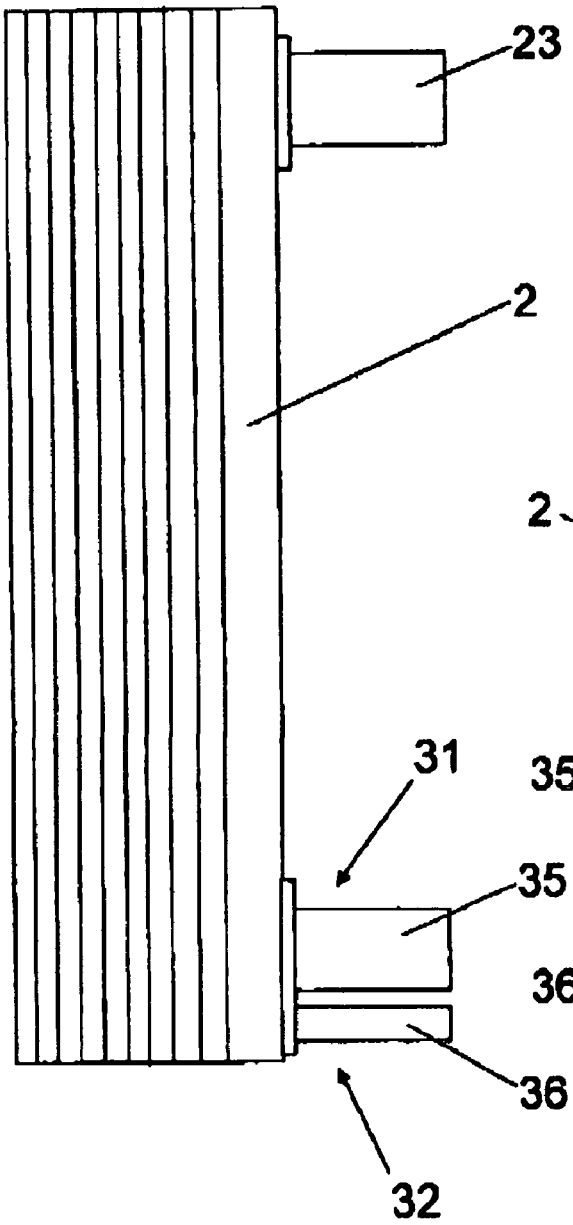
FIG. 1 discloses schematically a sideview of a plate heat exchanger device according to a first embodiment of the invention.
Figure 2:
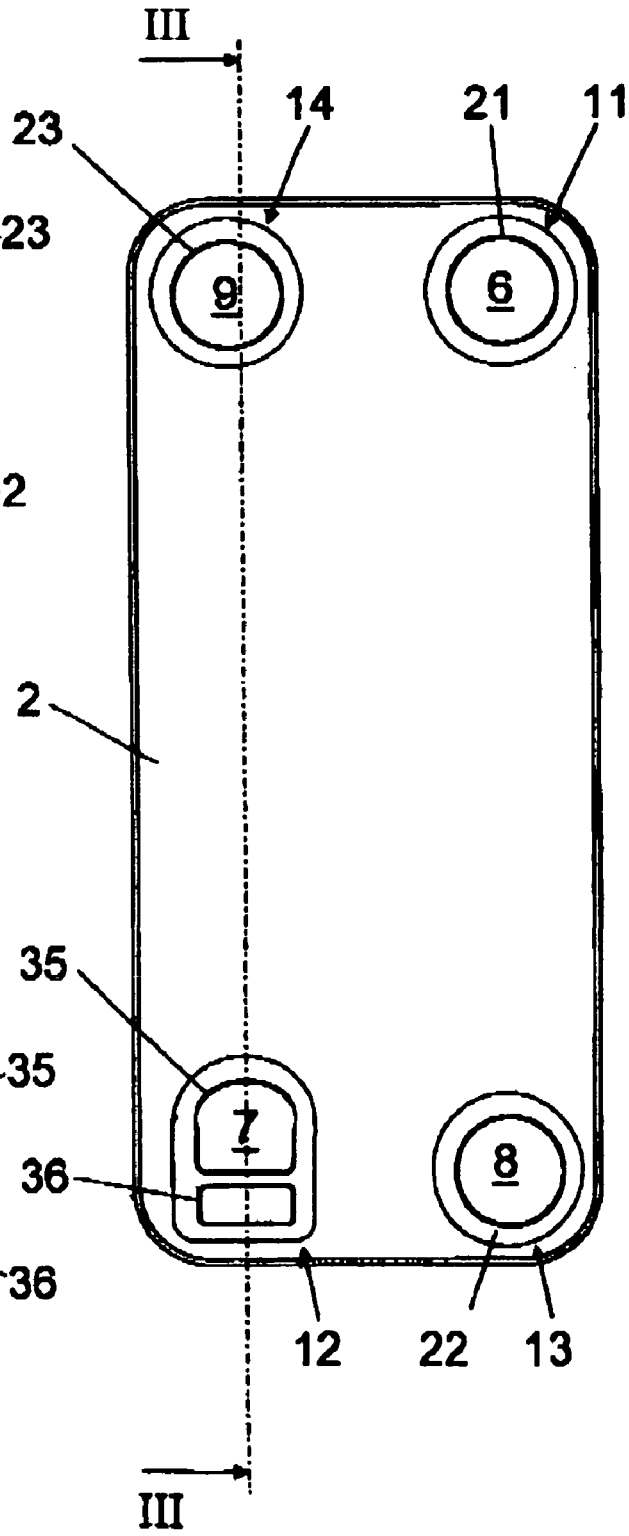
FIG. 2 discloses schematically another sideview of the plate heat exchanger in FIG. 1.
Figure 3:
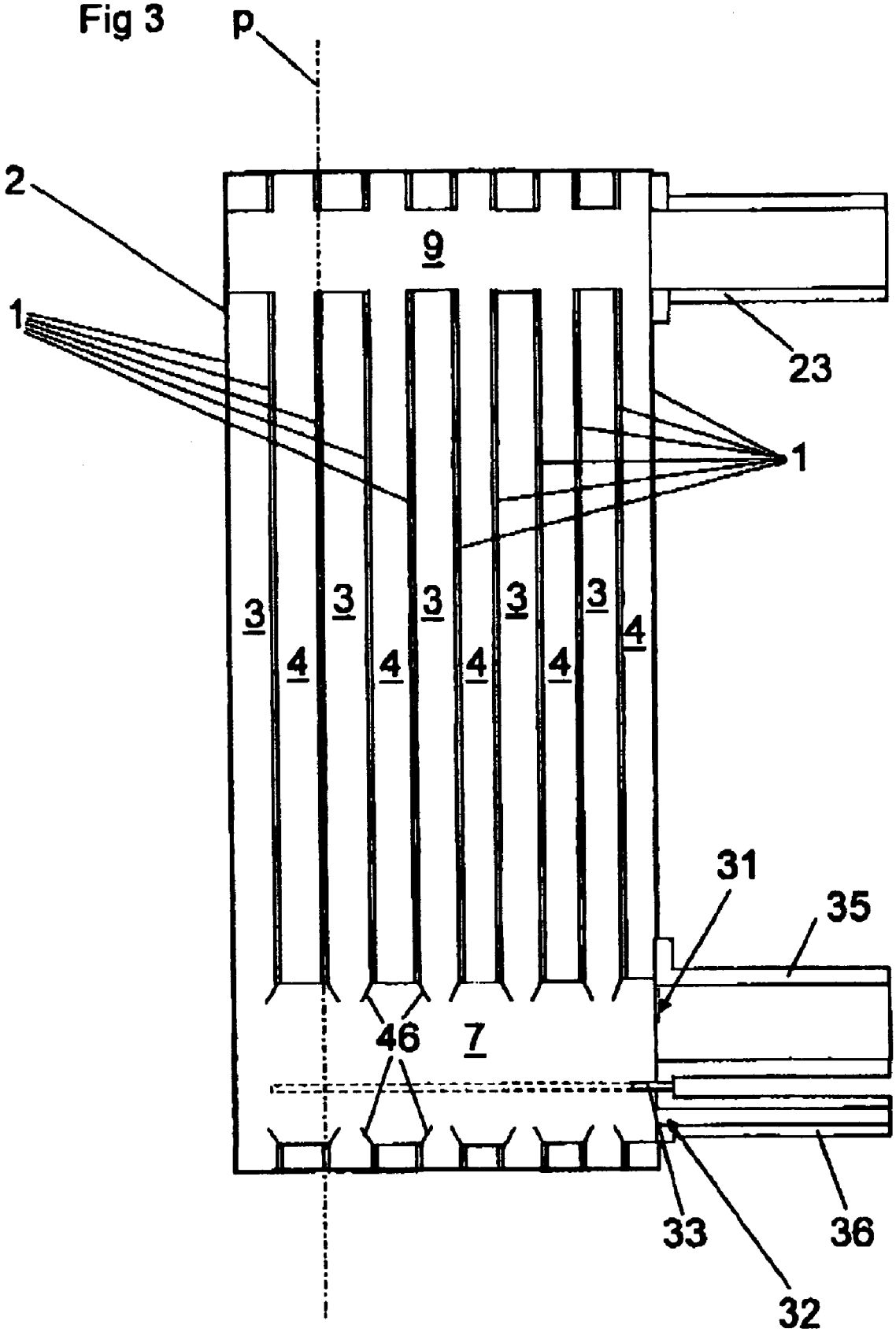
FIG. 3 discloses a sectional view along the line III-III in FIG. 2.

FIGS. 1 to 3 discloses a plate heat exchanger according to the first embodiment of the invention. The plate heat exchanger includes a number of heat exchanger plates 1, which form a plate package 2 and which each includes a main extension plane p, see FIG. 3. The heat exchanger plates 1 are pressed to such a shape that when they are provided beside each other to said plate package 2, a plate interspace is formed between each pair of plates 1. The plate interspaces, which completely or partly also may be formed by distance members, for instance gaskets, provided between the plates, are arranged to form first passages 3 for a first medium and second passages 4 for a second medium. The first passages 3 are separated from the second passages 4. Furthermore, the first passages 3 and the second passages 4 are arranged beside each other in an alternating order, i.e. substantially each first passage 3 is surrounded by two second passages 4.

The plate package 2 includes in the embodiment disclosed heat exchanger plates 1, which are permanently connected to each other by means of brazing or any similar method, wherein all heat exchanger plates 1 are substantially identical except for one of the end plates, which in the embodiment disclosed lacks portholes. It is to be noted, however, that the invention is not limited to brazed or in any other way permanently mounted plate packages 2, but is also applicable to plate packages kept together by means of two end plates and tension bolts extending through the end plates.

Furthermore, the plate package 2 includes four port channels 6, 7, 8 and 9. Each port channel 6-9 extends through all plates 1 except for said one end plate. Two of the port channels 6 and 7 communicate with the first passages 3, see FIG. 3, wherein the port channel 6 forms a first inlet port channel 6 and extends to a first inlet 11 for the first medium, and the port channel 7 forms a first outlet port channel 7 and extends to a first outlet 12 for the first medium. The two other port channels 8 and 9 communicate with the second passages 4, wherein the port channel 8 forms a second inlet port channel 8 and extends to a second inlet 13 for the second medium, and the port channel 9 forms second inlet port channel 9 and extends to a second outlet 14 for the second medium. It is to be noted that the plate heat exchanger device according to the invention also may be of a type that has another number of port channels, for instance two or six port channels and/or another number of passages for various media.

Figure 5:
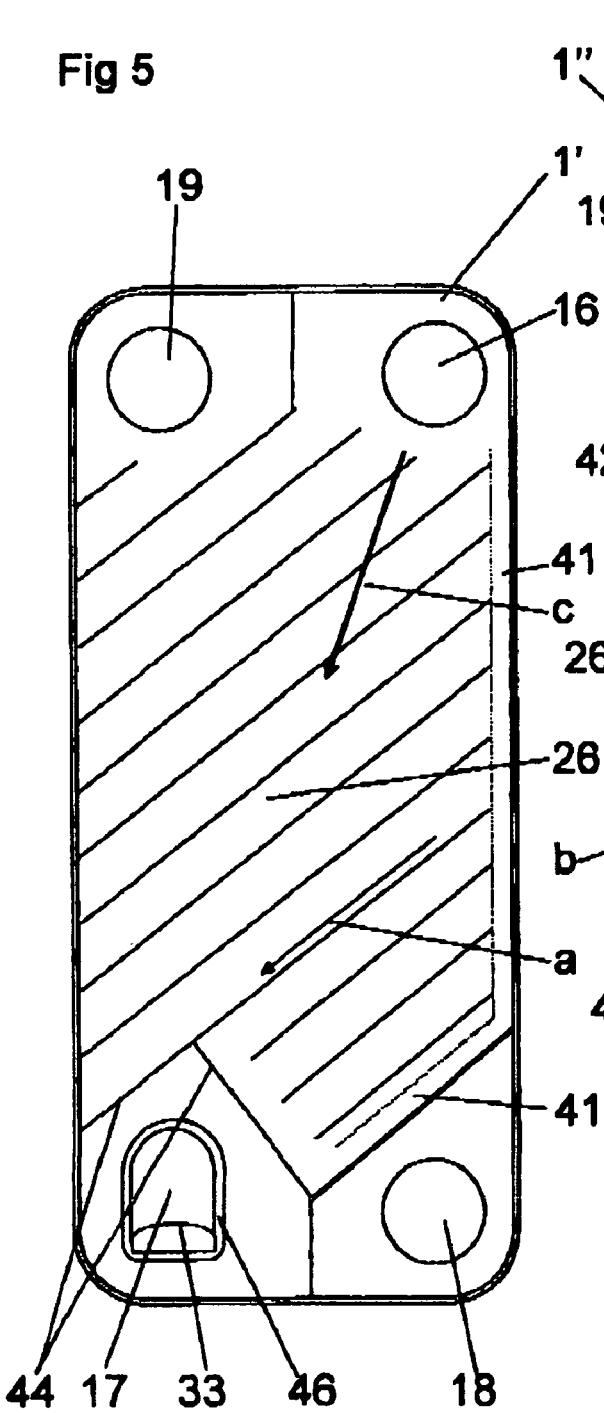
FIG. 5 discloses schematically a first heat exchanger plate of the plate heat exchanger device in FIG. 1.
Figure 6:
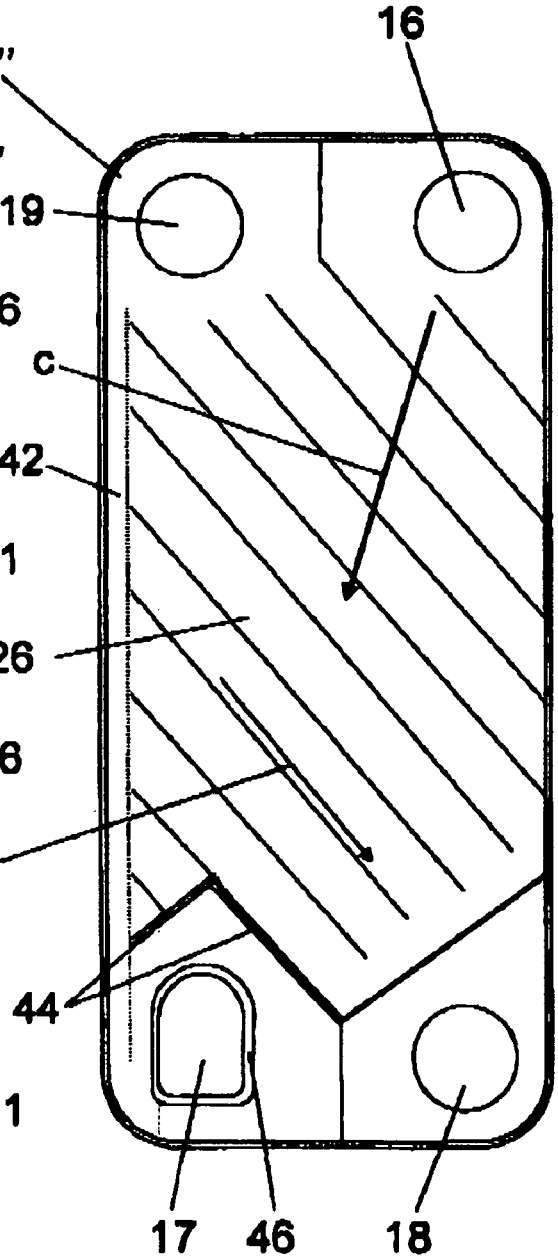
FIG. 6 discloses schematically a second heat exchanger plate of the plate heat exchanger device in FIG. 1.

Each port channel 6-9 is formed by an opening or a porthole 16-19 in each heat exchanger plate 1 in the plate package 2 except for said one end plate, see FIG. 5 and 6. The portholes 16, 18 and 19, which form the port channels 6, 8 and 9, are in the first embodiment circular seen in the direction of the port channels 6, 8, 9. Each port channel 6, 8, 9 is connected to a respective conduit pipe 21, 22, 23 extending from the plate package 2 for the supply and removal, respectively, of medium. In particular, the pipe 21 and the port channel 6 permit feeding and transport of the first medium to the first passages 3. The pipe 22 and the port channel 8 permit feeding and transport of the second medium to the second passages 4, and the pipe 23 and the port channel 9 permit discharge and transport of the second medium from the second passages 4.

The plate package 2 has during normal use an upper end and a lower end located below the upper end with regard to the direction of gravity, wherein the first inlet 11 is located in the proximity of the upper end and the first outlet 12 is located in the proximity of the lower end. The second inlet 13 is in the disclosed embodiments, operating according to the counterflow principle, located at the lower end whereas the second outlet 14 is located at the upper end. It is to be noted that the plate heat exchanger device also may be designed to operate according to the parallel flow principle.

In the embodiments disclosed, the plate heat exchanger device is arranged to enable cooling of the first medium in the first passages 3 by means of the second medium in the second passages 4. The first medium may, as mentioned initially, for instance be pressurised air to be cooled and dried before it is supplied to the equipment where it is to be used. The first medium thus includes a gaseous medium or a gas, and a liquid medium or a liquid or moisture. Due to the cooling of the first medium, liquid or moisture will precipitate or condense in the first medium due to known physical principles. Substantially each heat exchanger plate 1, 1', 1", see FIGS. 5 and 6, includes a heat transfer area with a corrugation including ridges and valleys.

In the embodiments disclosed, two different heat exchanger plates 1 are used in the plate package 2. FIG. 5 discloses a first heat exchanger plate 1', on which the corrugation 26 of ridges and valleys is inclined and extends obliquely upwardly in a first direction a. FIG. 6 discloses a second heat exchanger plate 1", on which the corrugation of ridges and valleys is inclined and extends obliquely upwardly in a second direction b. The flow of the first medium flows in a main flow direction c obliquely downwardly from the first inlet 11 to the first outlet 12. A corrugation 26 of ridges and valleys contributes to redirect the flow of the first medium a large number of times when it flows from the first inlet 11 to the first outlet 12, and in such a way, the corrugation 26 will catch liquid from the first medium.

The port channel 7, forming the first outlet 12 for the first medium includes or forms a gas outlet 31, which is arranged to permit discharge of substantially gas of the first medium, and a liquid outlet 32, which is arranged to permit discharge of substantially liquid of the first medium. The liquid outlet 32 is provided in or in the proximity of the gas outlet 31. In the first embodiment, the first outlet 12 is formed by one single porthole 17 in each heat exchanger plate 1 except for said one end plate, wherein this porthole 17 has a larger opening area than the porthole 16, 17, 18, 19, which form the other port channels 6, 8, 9. Furthermore, the porthole 17 has a total height which is substantially longer than its total width, which appears from FIGS. 5, 6 and FIGS. 7, 8. The port channel 7 is however divided by means of a dividing piece 33, which extends in the port channel 7 from said one end plate in such a way that the upper gas outlet 31 and the lower gas outlet 32 are formed. The gas outlet 31 will thus be separated from the liquid outlet 32.

As appears from FIG. 5, the gas outlet 31 has an outlet opening which is larger than the outlet opening of the liquid outlet 32. Furthermore, the outlet opening of the gas outlet 31 has a centre point which during normal use is located at a higher level than a centre point of the outlet opening of the liquid outlet 32 with regard to the gravity. FIG. 3 discloses with continuous lines a dividing piece 33 extending a short distance into the port channel 7. However, with dashed lines it is shown that the dividing, piece may extend through substantially the whole length of the port channel 7. The dividing piece 33 may include or be formed by a simple sheet which may have a somewhat curved shape being convex seen from the gas outlet 31, see FIG. 5, wherein possible liquid precipitating on the dividing piece 33 may flow outwardly and downwardly from the gas outlet 31.

The gas outlet 31 includes or is connectable to a gas discharge conduit 35 extending from the plate package 2 for discharge and transport of substantially gas of the first medium. The liquid outlet 32 includes or is connectable to a separate liquid discharge conduit 36, which also extends from the plate package 2 and is separated from the gas discharge conduit for separate discharge and transport of substantially liquid of the first medium. The collected liquid may thus in a convenient manner be conveyed to for instance a separate collecting tank or effluent outlet. The gas from the gas discharge conduit 25 may be so dry that no further liquid separator is necessary.

Figure 4:
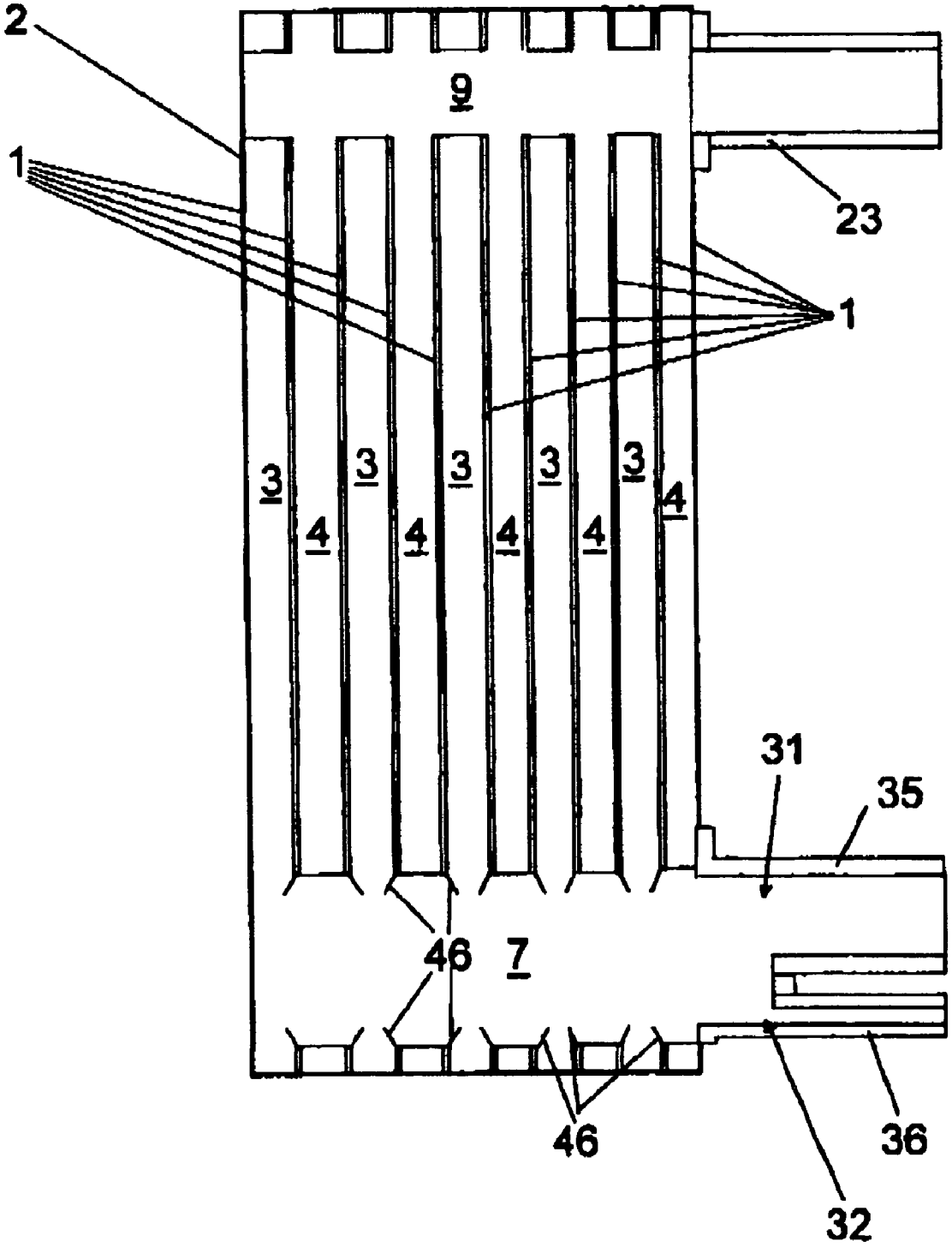
FIG. 4 discloses a sectional view similar to the one in FIG. 3 of a plate heat exchanger device according to a second embodiment of the invention.

FIG. 4 discloses a plate heat exchanger device according to a second embodiment, which differs from the first embodiment in that the port channel 7 merely has a larger opening area and a longer height/width relation than the rest of the port channels, in particular than the port channel 6 but also than the port channels 8 and 8. Moreover, in the second embodiment any dividing of the port channel 7 is missing, but this embodiment is built on the principal that the first medium will be stratified in the port channel 7 so that a separate upper gas flow and a separate liquid flow in the lower part of the port channel are formed. The two separate flows are conveyed to a gas outlet 31 with a connecting gas discharge conduit 35 and to a liquid outlet with a connecting liquid discharge conduit 36, respectively. It is to be noted that the gas outlet 31 and the liquid outlet 32 with the connecting conduits 35 and 36 in the disclosed second embodiment are located completely outside the plate package 2 proper.

As is indicated in FIGS. 5 and 6, each first passage 3 includes in the embodiments disclosed two liquid channels 41, 42 extending along a substantial part of the first passage 3 in a direction towards the first outlet 12 and more precisely towards the liquid outlet 32. The liquid channels 41, 42 are thus arranged to convey the liquid of the first medium to the liquid outlet 32. The liquid channels 41, 42 may advantageously be formed by a shaping of at least one of the two heat exchanger plates 1' and 1" which delimits each first passage 3. In the embodiments disclosed the corrugation 26 of ridges and valleys of the heat exchanger plate 1' extends in the direction a towards the liquid channel 42 formed on the heat exchanger plate 1", whereas the corrugation 26 of ridges of valleys of the heat exchanger plate 1" extends in the direction b towards the liquid channel 41 formed on the heat exchanger plate 1'. The corrugation 26 on each of the plates 1' and 1" thus conveys the caught liquid to a liquid channel 42 and 41, respectively. It is to be noted however, that the corrugation 26 of ridges and valleys of the heat exchanger plate 1' also may extend towards the liquid channel 41 on this plate 1', and that the corrugation 26 of ridges and valleys of the heat exchanger plate 1" may extend in the direction b towards the liquid channel 42 on this plate 1".

In the embodiments disclosed, the liquid channels 41, 42 extend immediately inside the outer side edge of the first passage 3. The liquid channels 41, 42 or one liquid channel 41, 42 may however have another position on the heat exchanger plate 1', 1", for instance along a substantially vertical centre line, wherein the ridges and valleys of the corrugation 26 may form an arrow pattern in a manner known per se.

Furthermore, each heat exchanger plate 1' and 1", limiting every first passage 3, includes a transversal ridge 44 which projects into the first passage 3 in the proximity of the first outlet 12 and more precisely just above the gas outlet 31. Such a ridge 44 will redirect the flow of the first medium before it reaches the first outlet 12, wherein liquid of the first medium is prevented from reaching the gas outlet 31. The transversal ridge 44 extends substantially transversally to the first flow direction c.

Furthermore, in the embodiments disclosed the heat exchanger plates 1' and 1", delimiting substantially each passage 3, is formed in such a way that the transition between the first passage 3 and the port channel 7 of the first outlet 12 forms a throttling for the first medium flowing out into the port channel 7. The throttling is formed by an edge area 46, which extends around at least the first outlet 12, or more precisely around each porthole 17, and inwardly towards a centre plane of the plate interspace forming the first passage 3.

Figure 7:
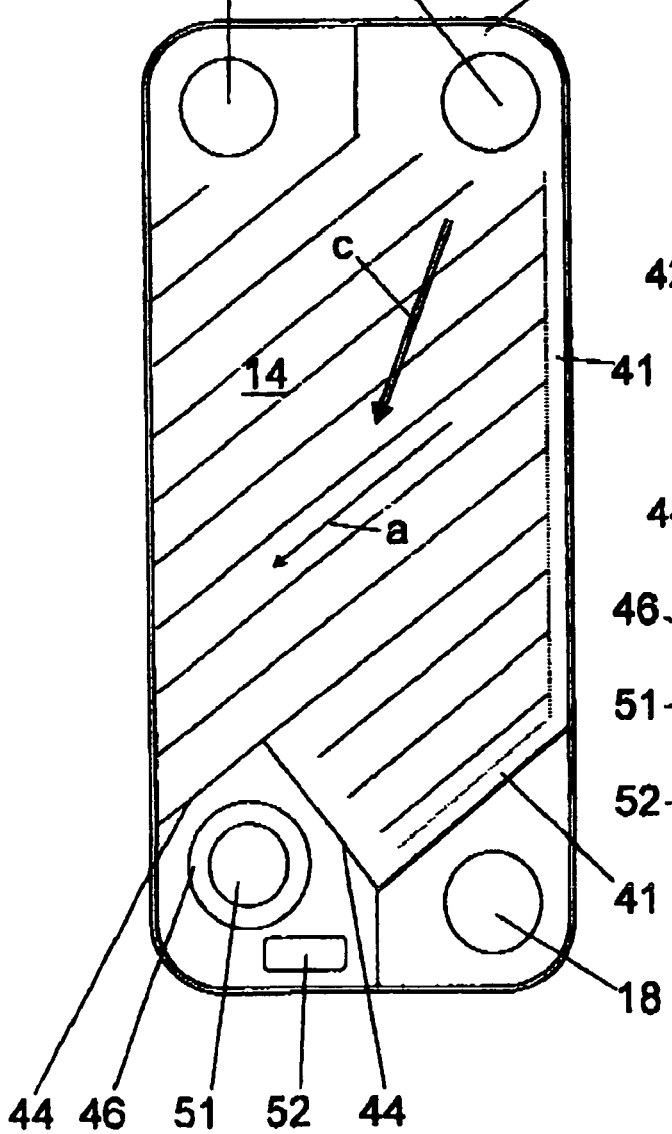
FIG. 7 discloses schematically a first heat exchanger plate of a plate heat exchanger device according to a third embodiment of the invention.
Figure 8:
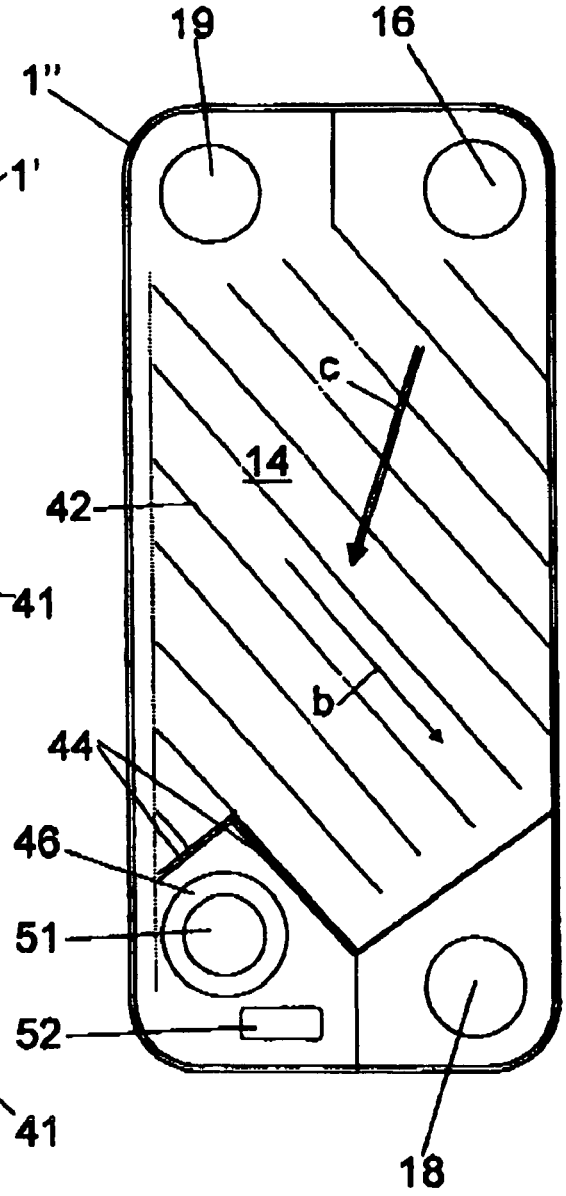
FIG. 8 discloses schematically a second heat exchanger plate of the plate heat exchanger device according to the third embodiment.

FIGS. 7 and 8 disclose two heat exchanger plates 1', 1" according to a third embodiment. According to this embodiment, one of the portholes is divided into two separate portholes 51, 52. These two portholes 51, 52, are included by or correspond to the porthole 17 in the first embodiment. In the second embodiment, the portholes 51 of substantially all heat exchanger plates 1', 1" form the gas outlet 31, and the portholes 52 of substantially all heat exchanger plates 1', 1" form the liquid outlet 32. As appears from FIGS. 7 and 8, the edge area 42 forming the throttling mentioned above is merely provided around the portholes 51 forming the gas outlet 31.

Figure 9:
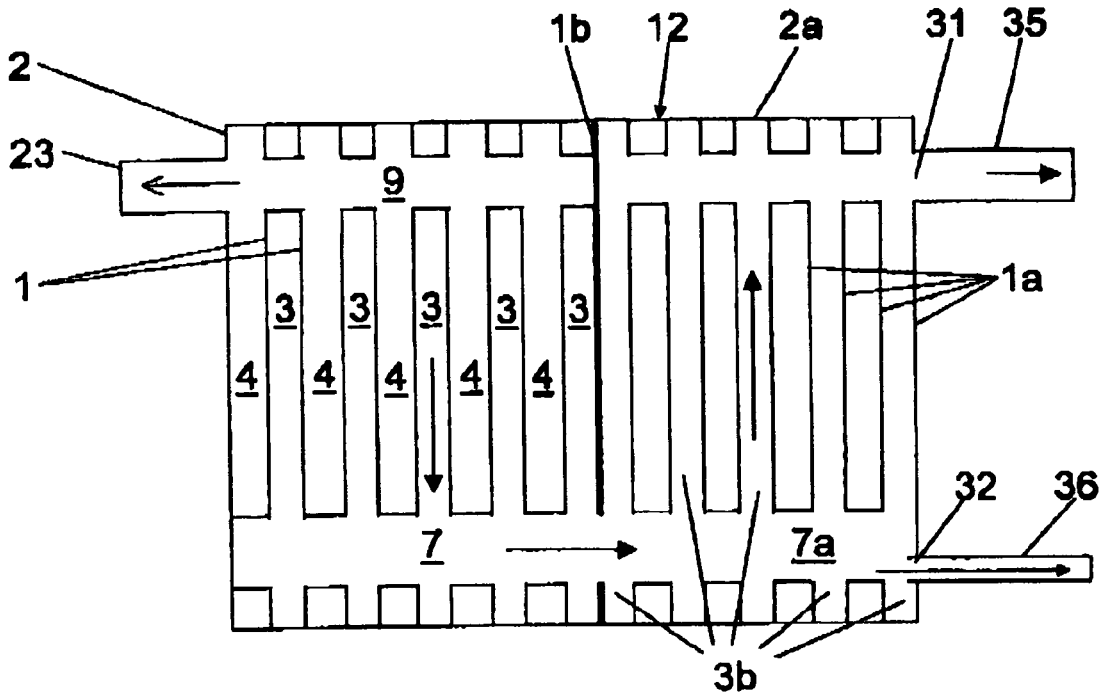
FIG. 9 discloses schematically a first sectional view through a plate heat exchanger device according to the fourth embodiment of the invention.
Figure 10:
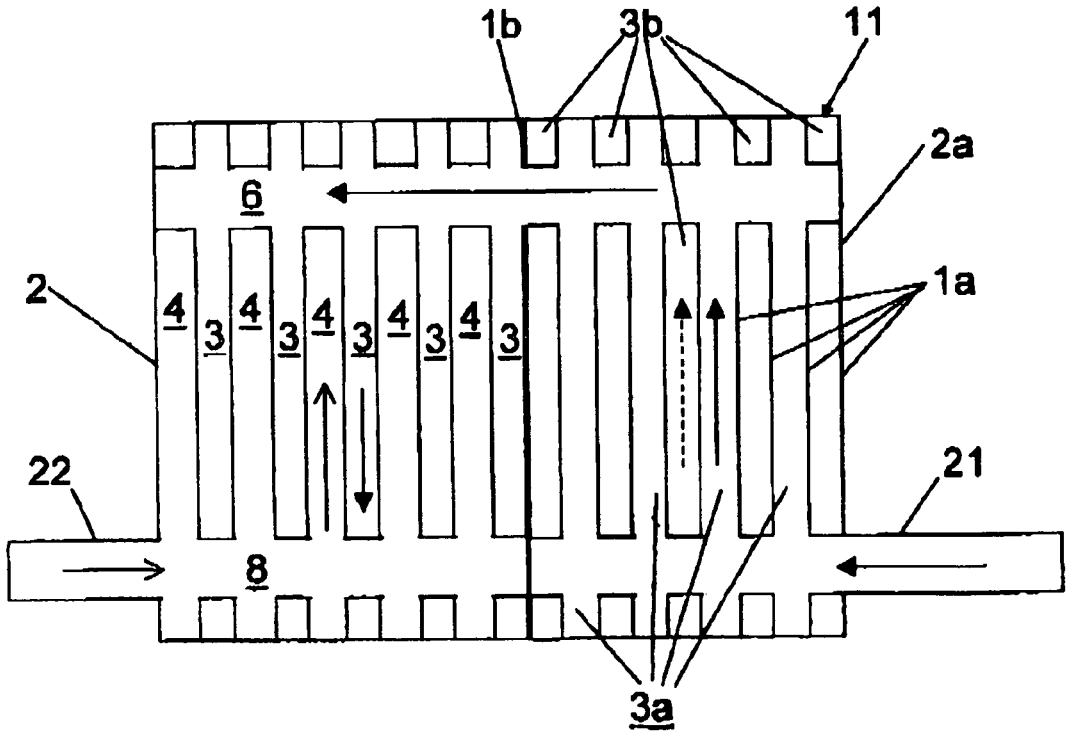
FIG. 10 discloses schematically a second sectional view through the plate heat exchanger device in FIG. 9.

FIGS. 9 and 10 disclose a fourth embodiment of the plate heat exchanger device. It is here to be noted that elements having substantially the same function have been given the same name and been provided with the same reference signs in all the embodiments disclosed. This fourth embodiment differs from the first embodiments in that further heat exchanger plates 1*a* are provided beside each other and form a further plate package 2*a*. This further plate package 2*a* is provided beside the plate package 2 as this is disclosed in the first embodiments. The further heat exchanger plates 1*a* have substantially the same dimensions as the heat exchanger plates 1 in such a way that the two plate packages 2 and 2*a* together may form one single common plate package 2, 2*a*. The further heat exchanger plates 1*a* are provided in such a way that further plate interspaces 3*a*, 3*b* are formed between the plates 1*a*. The two plate packages 2, 2*a* are separated from each other by a separating plate 1*b*, which has merely two portholes instead of four portholes of substantially all plates 1, 1*a*.

The further plate interspaces 3*a*, 3*b*, disclosed in the fourth embodiment, are intended to convey the first medium. The plate interspaces 3*a*, which substantially consists of every second one of the further plate interspaces 3*a*, 3*b*, form a part of the first inlet 11. The first medium is thus conveyed via the conduit pipe 21 through the plate interspaces 3*a* to the first inlet port channel 6. The plate interspaces 3*b*, which substantially consist of every second one of the further plate interspaces 3*a*, 3*b*, form a part of the first outlet 12. The gaseous part of the first medium is thus conveyed from the first outlet port channel 7, via a corresponding port channel 7*a* of the plate package 2*a* through the plate interspaces 3*b* to the gas outlet 31 and the gas discharge conduit 35. The corresponding port channel 7*a* have the same size and the same shape as the first outlet port channel 7. Furthermore, the corresponding port channel 7*a* has the same position as the first outlet port channel 7 with regard to the extension plane p. The liquid part of the first medium is conveyed from the first outlet port channel 7 substantially straight through the corresponding port channel 7*a* to the liquid outlet 32 and the liquid discharge conduit 36. In such a way, the first medium will be conveyed in the plate interspaces 3*a* in heat exchanging contact with the first medium in the plate interspaces 3*b*. This means that the first medium, which is conveyed into the plate heat exchanger device may be precooled at the same time as the gaseous part of the first medium may be heated before the gas leaves the plate heat exchanger device. As appears from FIG. 10, the incoming first medium is conveyed substantially in parallel flow with the outgoing gaseous first medium in the plate package 2*a*.

Figure 11:
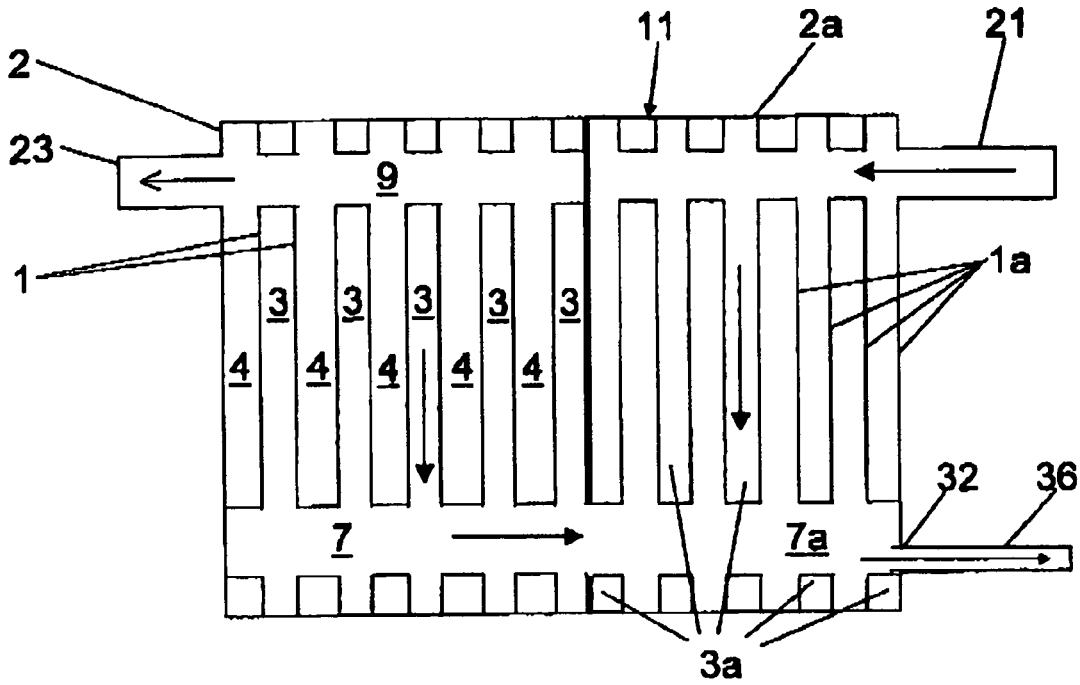
FIG. 11 discloses schematically a first sectional view through a plate heat exchanger device according to the fifth embodiment of the invention.
Figure 12:
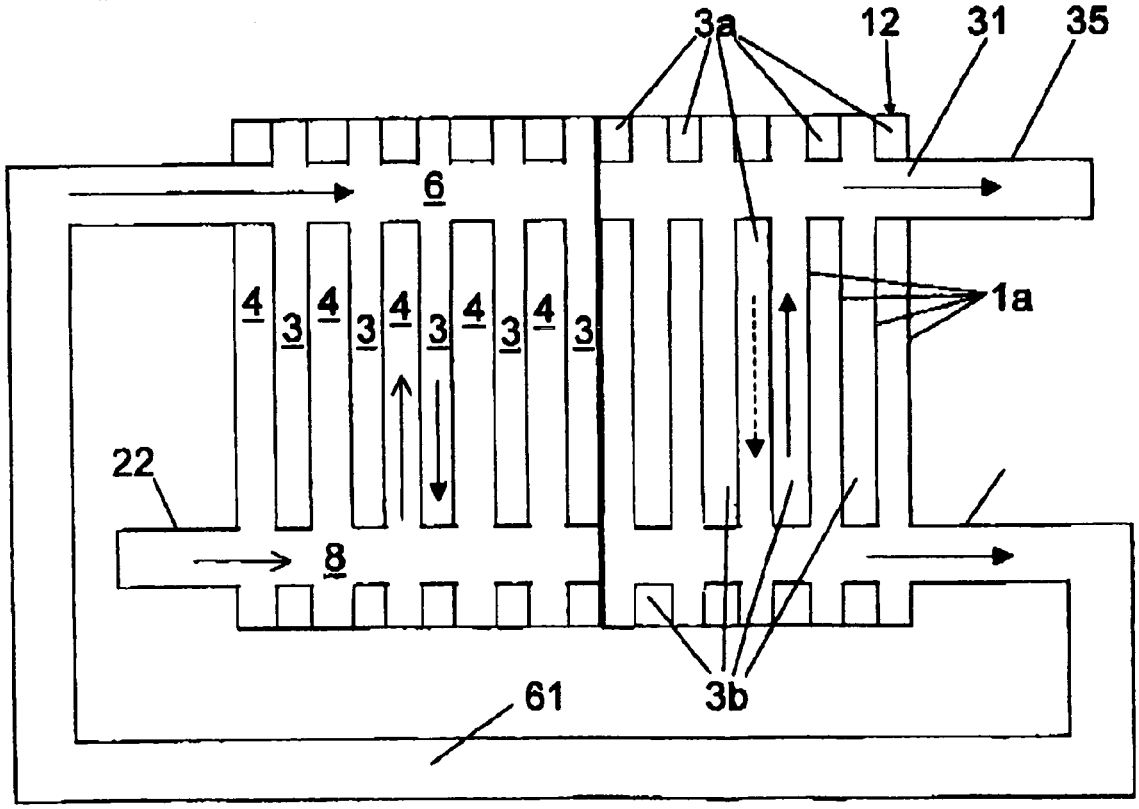
FIG. 12 discloses schematically a second sectional view through the plate heat exchanger device in FIG. 11.

FIGS. 11 and 12 disclose a fifth embodiment, which in a functional regard differs from the fourth embodiment in that the incoming first medium is conveyed in substantially counter flow to the outgoing gaseous first medium in the plate package 2*a*. In order to obtain such a counterflow function, the incoming and precooled first medium is conveyed from the plate packaged 2*a* via a bypass channel 61 to the plate package 2 for cooling by means of the second medium.

The first medium is thus conveyed via the conduit pipe 21 into the plate package 2*a* and through the plate interspaces 3*a* to the bypass channel 61. From the bypass channel 61, the first precooled medium is conveyed into the first inlet port channel 6 through the first passages 3 to the first outlet port channel 7. From the first outlet port channel 7, the gaseous part of the first medium is in the same way as in the fourth embodiment conveyed via a corresponding port channel 7*a* of the plate package 2*a* through the plate interspaces 3*b* to the gas outlet 31 and the gas discharge conduit 35. The liquid part of the first medium is conveyed from the first outlet port channel 7 substantially straight through the corresponding port channel 7*a* to the liquid outlet 32 and the liquid discharge conduit 36.

The invention is not limited to the embodiments disclosed but may be varied and modified within the scope of the following claims.

What is claimed is:

1. A plate heat exchanger device comprising a plate package (2) formed by a plurality of heat exchanger plates (1, 1', 1"), which are adjacent to each other so that a plate interspace (3,4) is formed between adjacent plates, which plate interspaces form first passages (3) for a first medium and second passages (4) for a second medium that is arranged to cool the first medium, wherein the first passages (3) and the second passages (4) are arranged beside each other in the plate package (2) in an alternating order, wherein the first passages (3) are separated from the second passages (4), wherein substantially each heat exchanger plate (1, 1', 1") has at least two portholes (16-19) forming a first inlet port channel (6) and a first outlet port channel (7), which extend through the plate package (2) to a first inlet (11) and to a first outlet (12), respectively, for the first medium to and from the first passages (3), wherein the first outlet (12) forms a gas outlet (31), which is arranged to permit discharge of substantially gas of the first medium, and a liquid outlet (32), which is arranged to permit discharge of substantially liquid of the first medium, wherein the liquid outlet (32) is separated from the gas outlet (31) for permitting separate discharge of said liquid and said gas, and wherein at least one of the two heat exchanger plates which delimits each first passage (3), is formed in such a way that a transition between the first passage (3) and the first outlet port channel (7) forms a throttle for the first medium flowing out into the first outlet port channel (7).

2. The device according to claim 1, wherein substantially each of the first passages (3) includes at least one liquid channel (41, 42) which extends along a substantial part of the first passage (3) in a direction towards the liquid outlet (32), and wherein at least one said liquid channel (41, 42) is arranged to convey liquid of the first medium to the liquid outlet (32).

3. The device according to claim 2, wherein said liquid channel (41, 42) is formed by a shaping of at least one of the two heat exchanger plates (1, 1', 1") that delimits each first passage (3).

4. The device according to claim 2, wherein said liquid channel (41, 42) extends immediately inside an outer edge of the first passage (3).

5. The device according to claim 2, wherein substantially each heat exchanger plate (1, 1', 1") includes a heat transfer area with a corrugation (26) including ridges and valleys, and wherein the corrugation (26) will catch liquid from the first medium.

6. The device according to claim 5, wherein the corrugation (26) of said ridges and valleys of one of the two heat exchanger plates (1, 1', 1") limiting each first passage (3) extends in a direction (a, b) towards said liquid channel (41, 42) and thus conveys the caught liquid to the liquid channel (41, 42).

7. The device according to claim 5, wherein the corrugation (26) of at least one of the two heat exchanger plates (1, 1', 1") limiting each first passage (3) includes a transversal ridge (44) projecting into the first passage (3) in the proximity of the first outlet (12) in such a way that liquid of the first medium is prevented from reaching the gas outlet (31).

8. The device according to claim 1, wherein the device is arranged to permit gas of the first medium to flow in a main first flow direction (c) from the first inlet port channel (6) to the first outlet port channel (7).

9. The device according to claim 8, wherein a transverse ridge (44) extends substantially transversally to the first flow direction (c).

10. The device according to claim 1, wherein the liquid outlet (32) is connectable to a liquid discharge conduit (36) which extends from the plate package (2).

11. The device according to claim 1, wherein the gas outlet (31) is connectable to a gas discharge conduit (35) which extends from the plate package (2).

12. The device according to claim 1, wherein the plate package (2) during normal use has an upper end and a lower end which is located beneath the upper end with regard to the direction of gravity, wherein the first inlet port channel (6) is located in the proximity of the upper end and the first outlet port channel (7) is located in the proximity of the lower end.

13. The device according to claim 12, wherein the gas outlet (31) has an outlet opening with a center point which during the normal use is located at a higher level than a center point of an outlet opening of the liquid outlet (32) with regard to the direction of gravity.

14. The device according to claim 1, wherein the gas outlet (31) has an outlet opening which has a larger flow area than an outlet opening of the liquid outlet (32).

15. The device according to claim 1, wherein said throttle is formed by an edge area (46) which extends around at least the gas outlet (31) and inwardly towards a center plane of the plate interspace.

16. The device according to claim 1, wherein each heat exchanger plate (1, 1', 1") has two further portholes (18, 19) forming a second inlet port channel (8) and a second outlet port channel (9), which extend through the plate package (2) and which form a second inlet (13) and a second outlet (14), respectively, for the second medium to and from the second passages (4).

17. The device according to claim 1, wherein the liquid outlet (32) is provided in or in the proximity of the gas outlet (31).

18. The device according to claim 1, wherein the first outlet (12) includes at least a further heat exchanger plate (1*a*), which is provided at the plate package for forming a further plate interspace to convey said gas from the first outlet port channel (7) to the gas outlet (31).

19. The device according to claim 18, wherein the further heat exchanger plate is provided at the plate package in such a way that it forms a part of the plate package.

20. The device according to claim 1, wherein the first outlet (12) includes a plurality of further heat exchanger plates, which are provided beside each other and at the plate package for forming further plate interspaces (3*a*, 3*b*), and wherein at least every second one (3*b*) of said further plate interspaces are arranged to convey said gas from the first outlet port channel (7) to the gas outlet (31).

21. The device according to claim 20, wherein said further heat exchanger plates are provided at the plate package in such a way that they form a part of the plate package.

22. The device according to claim 21, wherein every second (3*a*) of said further plate interspaces are arranged to form a part of the first inlet (11) and to convey the first medium to the first inlet port channel (6) in heat exchanging contact with said gas.

* * * * *

UNITED STATES PATENT AND TRADEMARK OFFICE

CERTIFICATE OF CORRECTION

PATENT NO. : 7,669,643 B2
APPLICATION NO. : 10/514669
DATED : March 2, 2010
INVENTOR(S) : Rolf Ekelund It is certified that error appears in the above-identified patent and that said Letters Patent is hereby corrected as shown below:

Abstract
Line 13, change "for discharge of liquid of the first medium." to -- for discharging of a liquid portion of the first medium. --.

Column 10
Line 23, change "at least one said" to -- said at least one --.

Signed and Sealed this

Fourth Day of May, 2010

David J. Kappos

David J. Kappos
*Director of the United States Patent and Trademark Office*